US011396782B2

(12) United States Patent
AlAdawy et al.

(10) Patent No.: US 11,396,782 B2
(45) Date of Patent: Jul. 26, 2022

(54) MILL TO WHIPSTOCK CONNECTOR FOR A WINDOW CUTTING SYSTEM

(71) Applicants: Ahmed AlAdawy, Dhahran (SA); Naeem-Ur-Rehman Minhas, Essex (GB); Asok Janardhanan Nair, Kerala (IN); Raghava Raju Lakhamraju, Dhahran (SA)

(72) Inventors: Ahmed AlAdawy, Dhahran (SA); Naeem-Ur-Rehman Minhas, Essex (GB); Asok Janardhanan Nair, Kerala (IN); Raghava Raju Lakhamraju, Dhahran (SA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/093,807

(22) Filed: Nov. 10, 2020

(65) Prior Publication Data

US 2022/0145713 A1 May 12, 2022

(51) Int. Cl.

| | |
|---|---|
| ***E21B 29/06*** | (2006.01) |
| ***E21B 23/04*** | (2006.01) |
| ***E21B 17/02*** | (2006.01) |

(52) U.S. Cl.
CPC ..... *E21B 23/0412* (2020.05); *E21B 17/02* (2013.01); *E21B 29/06* (2013.01)

(58) Field of Classification Search
CPC ..... E21B 29/00; E21B 29/06; E21B 43/04; E21B 43/0412
See application file for complete search history.

(56) References Cited

U.S. PATENT DOCUMENTS

2010/0224372 A1* 9/2010 Stowe ..... E21B 41/00 166/377

* cited by examiner

*Primary Examiner* — Kristyn A Hall
(74) *Attorney, Agent, or Firm* — Cantor Colburn LLP

(57) ABSTRACT

A window cutting system includes a whipstock having an outer surface, an inner surface, a recess, and a passage extending through the outer surface and the inner surface in the recess. A window mill is connected to the whipstock. The window mill includes a body having a tip portion, a pressure compartment formed in the tip portion, and an axial passage extending though the tip portion from the pressure compartment. A pin connects the window mill and the whipstock. The pin is arranged in the pressure compartment and extends through the axial passage and the passage into the recess. The pin is axially shiftable relative to the window mill and the whipstock when exposed to pressure in the pressure compartment.

20 Claims, 6 Drawing Sheets

MILL TO WHIPSTOCK CONNECTOR FOR A WINDOW CUTTING SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, the window mill/whipstock is made up on a rig floor. The window mill includes a threaded hole and the whipstock includes a lug hole. Typically, the whipstock is mounted in a rotary table and the window mill is brought into position such that the threaded hole and lug hole are aligned. A shear bolt is passed through the lug hole and connected with the window mill. When the whipstock is in place and oriented, an anchor is activated. Orienting the whipstock and activating the anchor may cause the shear bolt to fracture pre-maturely resulting in an improper whipstock placement. Replacing the shear bolt and re-orienting the whipstock can be a difficult and time-consuming process. Given the need to increase efficiency, the art would be open to new systems for joining a window mill to a whipstock.

SUMMARY

Disclosed is a window cutting system including a whipstock having an outer surface, an inner surface, a recess, and a passage extending through the outer surface and the inner surface in the recess. A window mill is connected to the whipstock. The window mill includes a body having a tip portion, a pressure compartment formed in the tip portion, and an axial passage extending though the tip portion from the pressure compartment. A pin connects the window mill and the whipstock. The pin is arranged in the pressure compartment and extends through the axial passage and the passage into the recess. The pin is axially shiftable relative to the window mill and the whipstock when exposed to pressure in the pressure compartment.

Also disclosed is a resource exploration and recovery system including a surface system and a subsurface system including a tubular string extending from the surface system into an earth formation. The tubular string includes window cutting system including a whipstock having an outer surface, an inner surface having a recess, and a passage extending through the outer surface and the inner surface in the recess. A window mill connects to the whipstock. The window mill includes a body having a tip portion, a pressure compartment formed in the tip portion, and an axial passage extending though the tip portion from the pressure compartment. A pin connects the window mill and the whipstock. The pin is arranged in the pressure compartment and extending through the axial passage and the passage into the recess, the pin being axially shiftable relative to the window mill and the whipstock when exposed to pressure in the pressure compartment.

Still further disclosed is a method of disconnecting a window mill from a whipstock including running a tubular string including a window cutting system into a wellbore, introducing fluid into a pressure chamber in the window mill, shifting a pin in the window mill axially toward the whipstock, applying a torsional force to the window mill to break the pin, and shifting the window mill relative to the whipstock.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
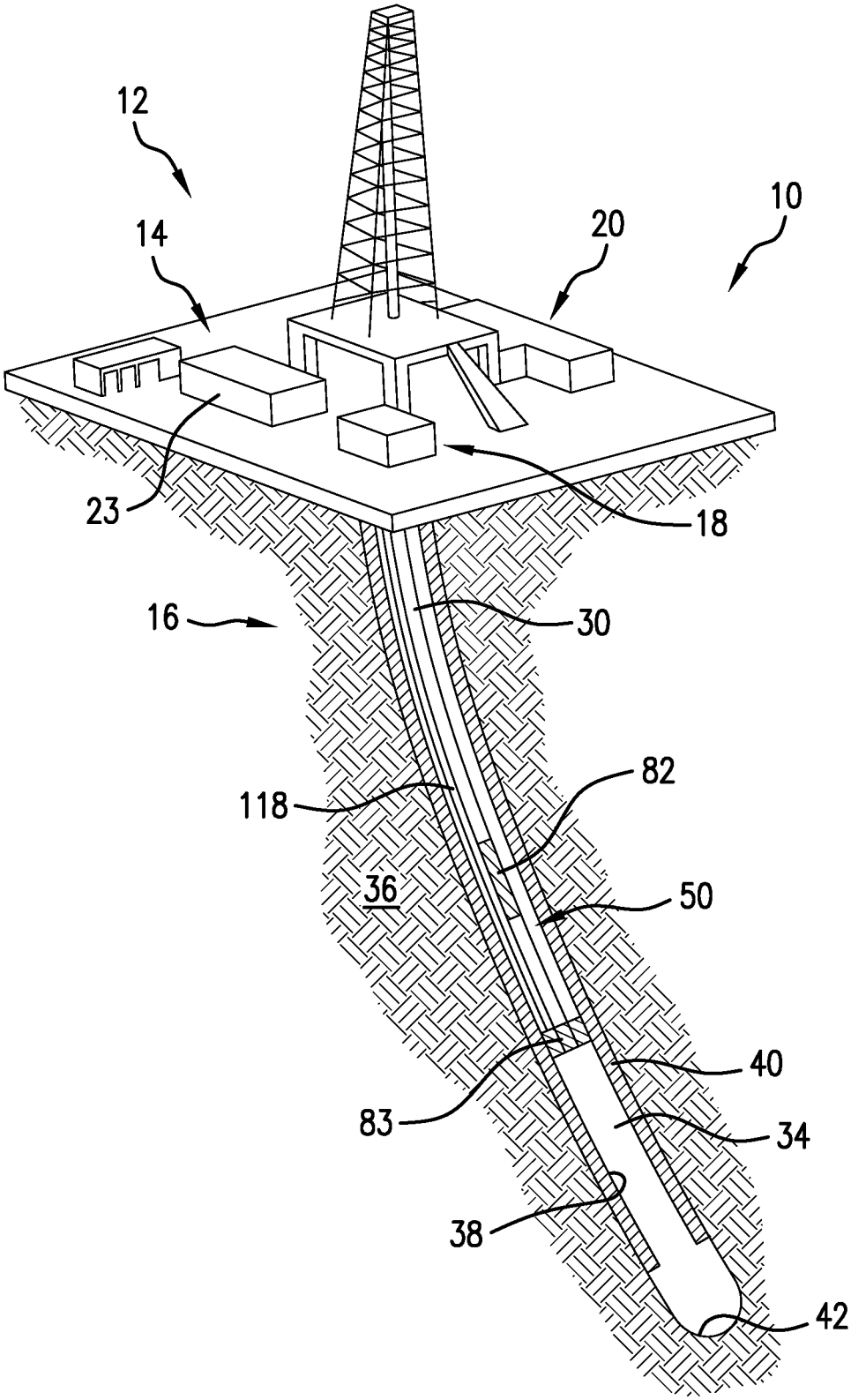
FIG. 1 depicts a resources exploration and recovery system including a window cutting system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from one or more tubulars (not separately labeled) that is extended into a wellbore 34 formed in an earth formation 36. Wellbore 34 includes an annular wall 38 that may be defined by a casing tubular 40 that extends from first system 12 towards a toe 42 of wellbore 34.

Figure 2:
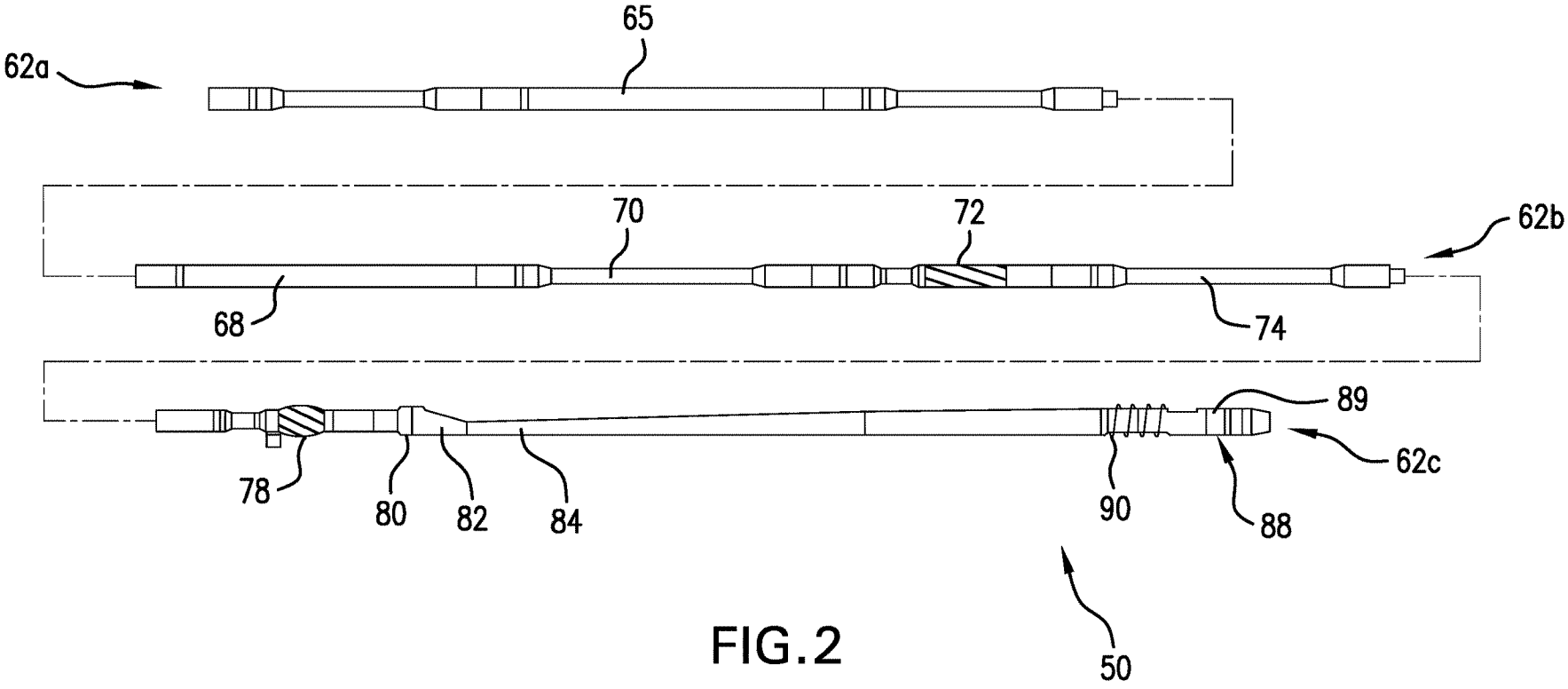
FIG. 2 depicts a window cutting system including a window mill and whipstock, in accordance with an exemplary embodiment.

In accordance with an exemplary aspect, a window cutting system 50 is connected to tubular string 30 as is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*. 62*b*, and 62*c* as shown in FIG. 2. Each segment 62*a*. 62*b*, and 62*c* may be made up off-site and delivered to first system 12 for introduction into wellbore 34.

In an embodiment, first segment 62*a* may support a measurement while drilling (MWD) system 65 that includes various instrumentation systems that monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock 82, and a tubular 84 that support an anchor 88 which may take the form of a selectively expandable packer 89. Third segment 62*c* may also support a brush or scraper 90 arranged adjacent to anchor 88.

Figure 3:
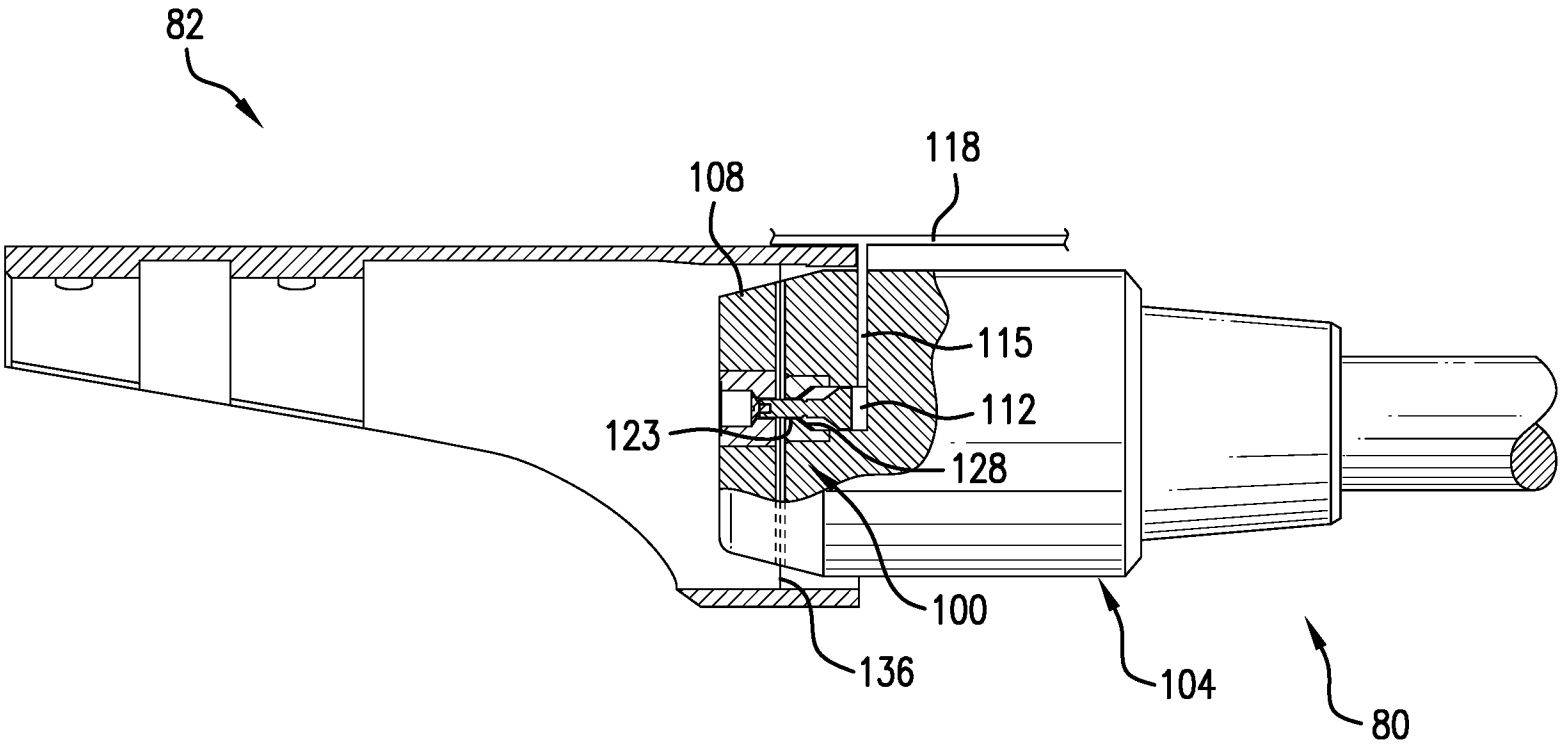
FIG. 3 depicts a glass view of the window mill joined to the whipstock through the connection system, in accordance with an exemplary aspect.
Figure 4:
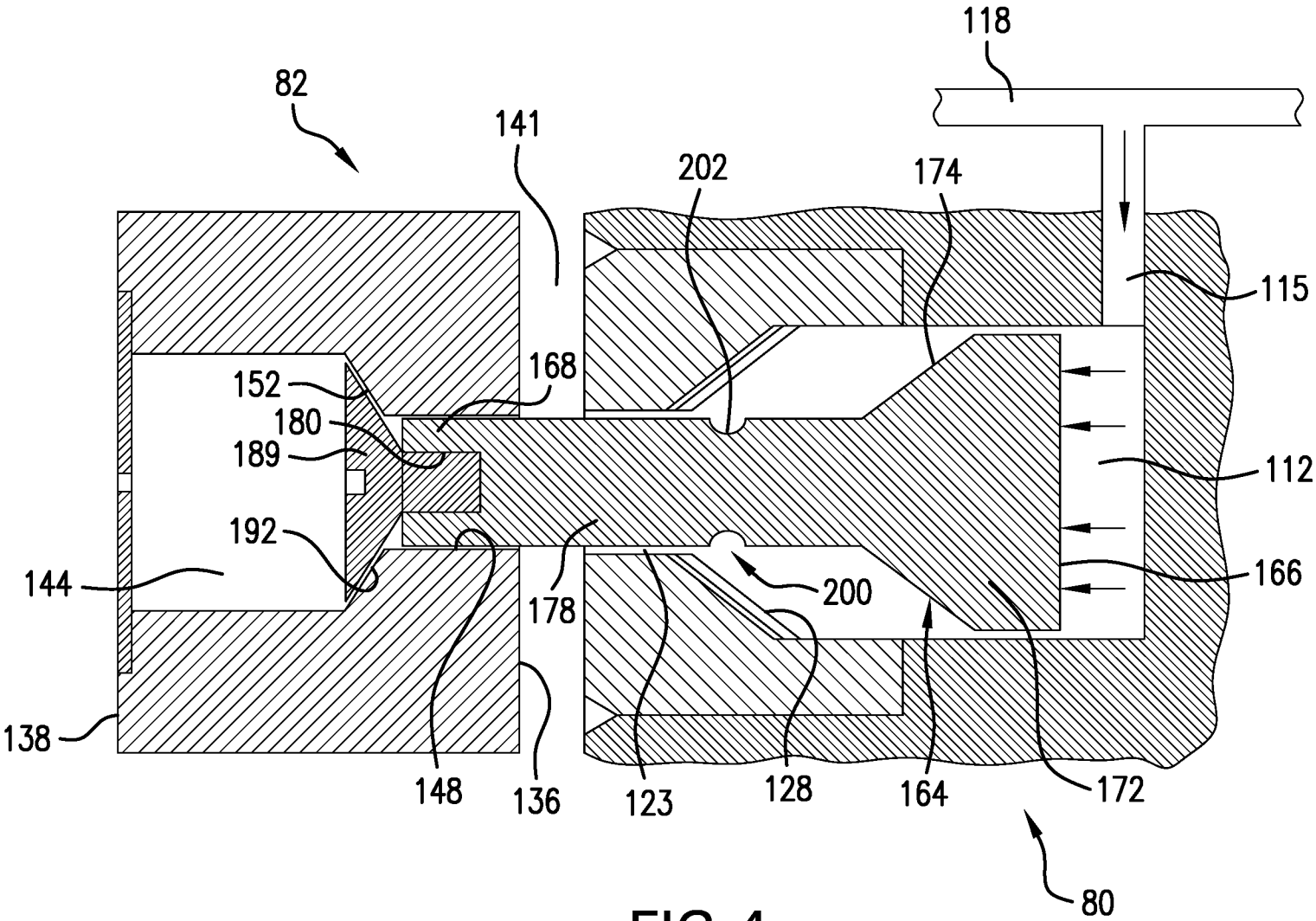
FIG. 4 depicts a cross-sectional side view of the window mill and whipstock in a run-in configuration, in accordance with an exemplary embodiment.
Figure 5:
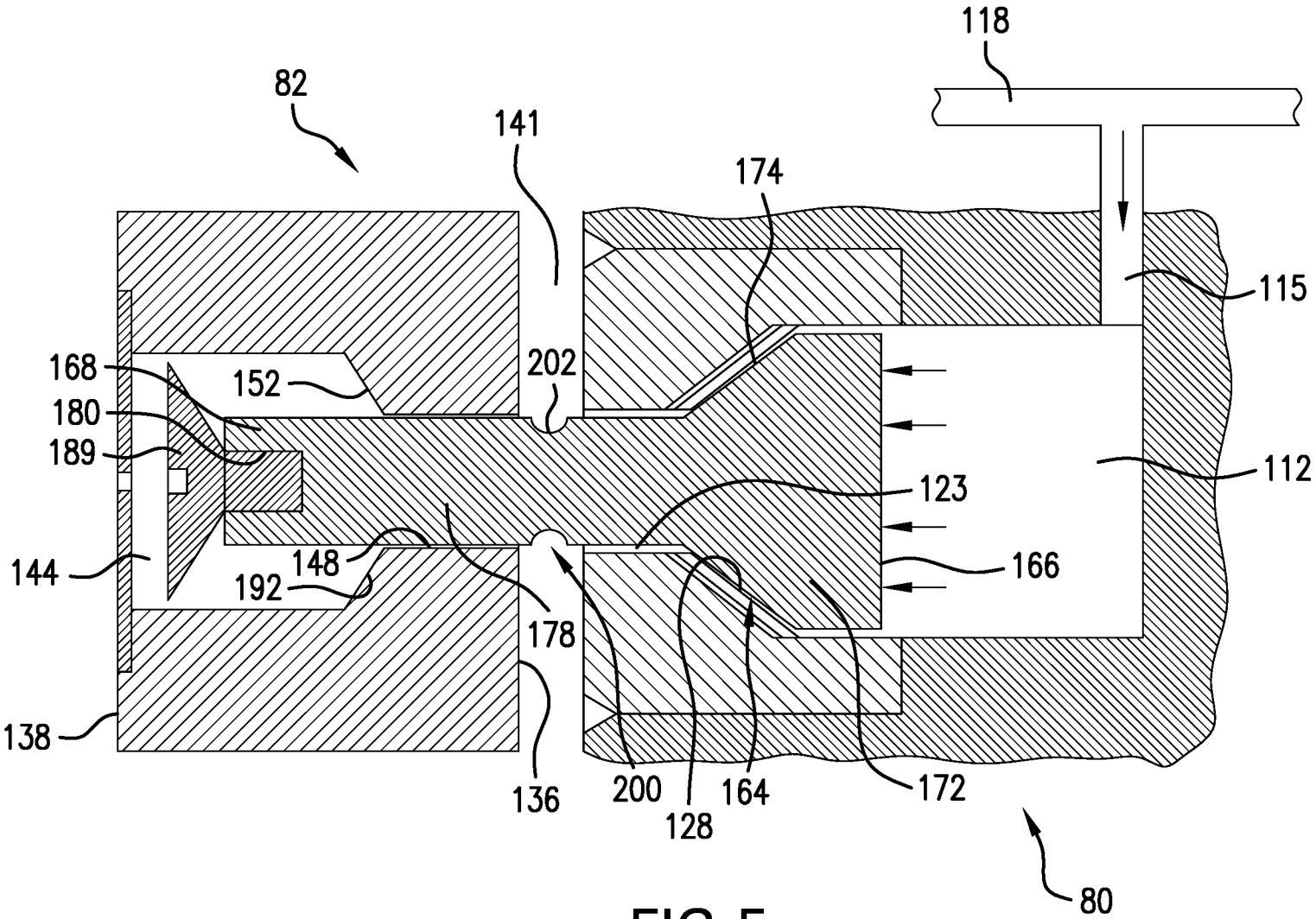
FIG. 5 depicts the window mill and whipstock of FIG. 4 in a ready to disconnect configuration, in accordance with an exemplary embodiment.

Referring to FIGS. 3-5, window mill 80 is secured to whipstock 82 through a connection system 100 as will be detailed herein. In an embodiment, window mill 80 includes a body 104 having a tip portion 108. A plurality of blades (not shown) extend along body 104 and support a number of cutting elements (also not shown). In accordance with an exemplary aspect, a pressure compartment 112 is disposed within body 104. A fluid port 115 extends through body 104 and is fluidically connected to pressure compartment 112. Fluid port 115 also connects with a hydraulic line 118 that extends from surface system 14 to packer 89. As will be detailed herein, in addition to providing an activating force to packer 89, hydraulic line 118 delivers an actuation force to pressure compartment 112 which separates window mill 80 from whipstock 82. Window mill 80 is also shown to include an axial passage 123 that extends from pressure compartment 112 through tip portion 108. Pressure chamber 112 includes an angled or tapered wall 128 that leads into axial passage 123.

Whipstock 82 includes a first surface 136 and a second surface 138. Second surface 136 may be recessed relative to an annular lip (not separately labeled) that receives tip portion 108. Second surface 136 is spaced from window mill 80 by a gap 141. Gap 141 may define a space between Second surface 136 and window mill 80 or merely represent a separable interface between components. Whipstock 82 includes a recess 144 that extends through first surface 138 toward second surface 136. A passage 148 extends from recess 144 through second surface 136 and aligns with axial passage 123. Recess 144 includes a tapered surface section 152 that leads into passage 148.

In accordance with an exemplary embodiment illustrated in FIG. 4, a pin 164 extends between and connects window mill 80 and whipstock 82. Pin 164 is slidable within pressure compartment 112 and recess 144 as will be discussed herein. Pin 164 may be rotationally fixed relative to window mill 80. Pin 164 includes a first end 166 disposed in pressure compartment 112 and a second end 168 that is disposed in recess 144. First end 166 defines a piston portion 172 having a tapered surface portion 174 that may nest within angled wall 128. Pin 164 also includes a shaft portion 178 that defines, at least in part, second end 168. Shaft portion 178 extends through axial passage 123 and passage 148. In an embodiment, shaft portion 178 has a diameter that forms a clearance fit relative to axial passage 123 and passage 148. The clearance fit may define a seal e.g., a tight or interference fit relative to passage 148 so as to prevent axial movement in the absence of a motivating force.

In an embodiment, second end 168 of pin 164 includes an opening 180 which may take the form of a threaded cylindrical bore (not separately labeled) that receives a mechanical fastener 189. Mechanical fastener 189 includes a tapered surface 192 that may nest against tapered surface section 152. Tapered surface 192 prevents mechanical fastener 189 from coming out of recess 144. As will be detailed herein, pin 164 selectively secures window mill 80 to whipstock 82. That is, in addition to maintaining the connection, pin 164 also facilitates a separation of window mill 80 from whipstock 82 prior to a window milling operation as will be detailed herein.

In an embodiment, pin 164 includes an area of weakness 200 defined in shaft portion 178. Area of weakness 200 may take the form of a localized reduction in diameter 202. In operation, window cutting system 50 is run in to wellbore 34 with pin 164 securing window mill 80 to whipstock 82. Area of weakness 200 is located within pressure compartment 112 as shown in FIG. 4. Once in position and oriented, surface system 14 introduces a hydraulic fluid into hydraulic line 118. The hydraulic fluid flows to packer 89 locking window cutting system 50 to casing tubular 40.

Figure 6:
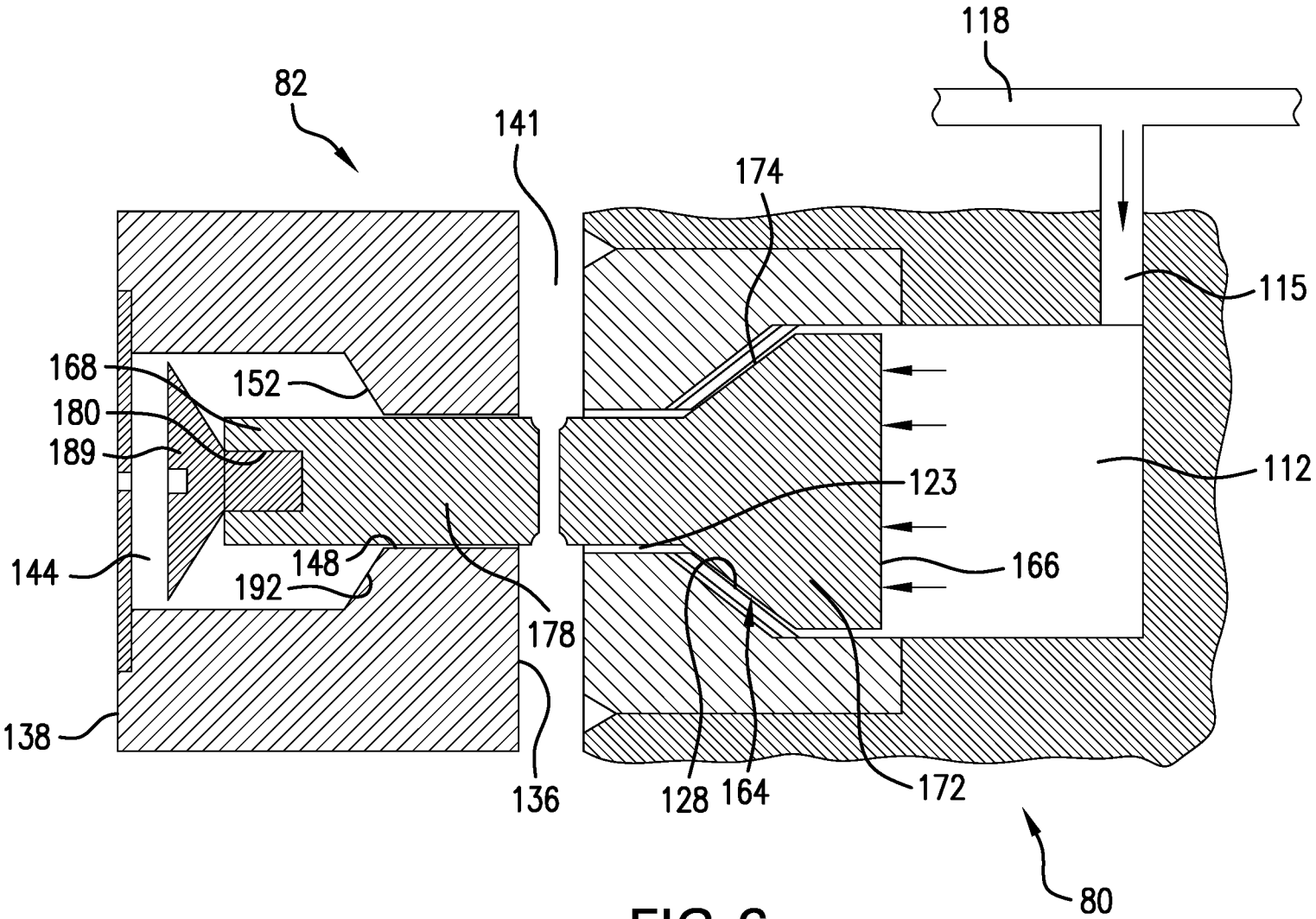
FIG. 6 depicts the window mill separated from the whipstock of FIG. 4 in a ready to disconnect configuration, in accordance with an exemplary embodiment

At the same time, the hydraulic fluid passes from hydraulic line 118, through fluid port 115 and into pressure compartment 112. The hydraulic fluid acts upon piston portion 172 forcing pin 164 toward whipstock 82 onto causing tapered surface portion 174 to rest against angled wall 128. In this position, area of weakness 200 is positioned at gap 141 as shown in FIG. 5. Once area of weakness 200 is positioned at gap 141, a torsional force may be applied to window cutting system 50 causing pin 164 to fail at area of weakness 200 separating window mill 80 from whipstock 82 as shown in FIG. 6. Once separated, a window cutting operation may commence.

Set forth below are some embodiments of the foregoing disclosure:

Embodiment 1

A window cutting system comprising: a whipstock including an outer surface, an inner surface, a recess, and a passage extending through the outer surface and the inner surface in the recess; a window mill connected to the whipstock, the window mill including a body having a tip portion, a pressure compartment formed in the tip portion, and an axial passage extending though the tip portion from the pressure compartment; and a pin connecting the window mill and the whipstock, the pin being arranged in the pressure compartment and extending through the axial passage and the passage into the recess, the pin being axially shiftable relative to the window mill and the whipstock when exposed to pressure in the pressure compartment.

Embodiment 2

The window cutting system according to any prior embodiment, further comprising: a fluid port extending through the window mill into the pressure compartment.

Embodiment 3

The window cutting system according to any prior embodiment, comprising: a hydraulic line connected to the fluid port.

Embodiment 4

The window cutting system according to any prior embodiment, further comprising: a gap extending between the whipstock and the window mill.

Embodiment 5

The window cutting system according to any prior embodiment, wherein the pin includes an area of weakness, the pin being selectively separable at the area of weakness to disengage the window mill from the whipstock.

Embodiment 6

The window cutting system according to any prior embodiment, wherein the pin is selectively shiftable between a first position, wherein the area of weakness is disposed in the pressure chamber, and a second position, wherein the area of weakness is disposed at the gap.

Embodiment 7

The window cutting system according to any prior embodiment, further comprising: a mechanical fastener extending into the pin in the recess.

Embodiment 8

The window cutting system according to any prior embodiment, wherein the mechanical fastener includes a tapered surface that selectively engages with a tapered surface section of the passage.

Embodiment 9

A resource exploration and recovery system comprising: a surface system; a subsurface system including a tubular string extending from the surface system into an earth formation, the tubular string including window cutting system comprising: a whipstock including an outer surface, an inner surface having a recess, and a passage extending through the outer surface and the inner surface in the recess; a window mill connected to the whipstock, the window mill including a body having a tip portion, a pressure compartment formed in the tip portion, and an axial passage extending though the tip portion from the pressure compartment; and a pin connecting the window mill and the whipstock, the pin being arranged in the pressure compartment and extending through the axial passage and the passage into the recess, the pin being axially shiftable relative to the window mill and the whipstock when exposed to pressure in the pressure compartment.

Embodiment 10

The resource exploration and recovery system according to any prior embodiment, further comprising: a fluid port extending through the window mill into the pressure compartment.

Embodiment 11

The resource exploration and recovery system according to any prior embodiment, further comprising: a hydraulic line connected to the fluid port.

Embodiment 12

The resource exploration and recovery system according to any prior embodiment, further comprising: a gap extending between the whipstock and the window mill.

Embodiment 13

The resource exploration and recovery system according to any prior embodiment, wherein the pin includes an area of weakness, the pin being selectively separable at the area of weakness to disengage the window mill from the whipstock.

Embodiment 14

The resource exploration and recovery system according to any prior embodiment, wherein the pin is selectively shiftable between a first position, wherein the area of weakness is disposed in the pressure chamber, and a second position, wherein the area of weakness is disposed at the gap.

Embodiment 15

The resource exploration and recovery system according to any prior embodiment, further comprising: a mechanical fastener extending into the pin in the recess.

Embodiment 16

The resource exploration and recovery system according to any prior embodiment, wherein the mechanical fastener includes a tapered surface that selectively engages with a tapered surface section of the passage.

Embodiment 17

A method of disconnecting a window mill from a whipstock comprising: running a tubular string including a window cutting system into a wellbore; introducing fluid into a pressure chamber in the window mill; shifting a pin in the window mill axially toward the whipstock; applying a torsional force to the window mill to break the pin; and shifting the window mill relative to the whipstock.

Embodiment 18

The method according to any prior embodiment, wherein shifting the pin includes positioning an area of weakness in the pin between the window mill and the whipstock.

Embodiment 19

The method according to any prior embodiment, wherein applying the torsional force includes shearing the area of weakness.

Embodiment 20

The method according to any prior embodiment, wherein introducing the fluid includes passing fluid from a surface system to a packer supported on the tubular string and into the pressure chamber.

The use of the terms “a” and “an” and “the” and similar referents in the context of describing the invention (especially in the context of the following claims) are to be construed to cover both the singular and the plural, unless otherwise indicated herein or clearly contradicted by context. Further, it should be noted that the terms “first,” “second,” and the like herein do not denote any order, quantity, or importance, but rather are used to distinguish one element from another.

The terms “about” and “substantially” are intended to include the degree of error associated with measurement of the particular quantity based upon the equipment available at the time of filing the application. For example, "about" and/or "substantially" can include a range of 8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A window cutting system comprising:

a whipstock including an outer surface, an inner surface, a recess, and a passage extending through the outer surface and the inner surface in the recess;

a window mill connected to the whipstock, the window mill including a body having a first end connectable to a tubular segment and a second end that is opposite the first end, the second end defining a tip portion, the body having a longitudinal axis that extends through the first end and the tip portion, a pressure compartment formed in the tip portion, and an axial passage extending along the longitudinal axis though the tip portion from the pressure compartment; and a pin connecting the window mill and the whipstock, the pin being arranged in the pressure compartment and extending along the longitudinal axis through the axial passage and the passage into the recess, the pin being axially shiftable along the longitudinal axis relative to the window mill and the whipstock when exposed to pressure in the pressure compartment.

2. The window cutting system according to claim 1, further comprising: a fluid port extending through the window mill into the pressure compartment.

3. The window cutting system according to claim 2, further comprising: a hydraulic line connected to the fluid port.

4. The window cutting system according to claim 1, further comprising: a gap extending between the whipstock and the window mill.

5. The window cutting system according to claim 4, wherein the pin includes an area of weakness, the pin being selectively separable at the area of weakness to disengage the window mill from the whipstock.

6. The window cutting system according to claim 5, wherein the pin is selectively shiftable between a first position, wherein the area of weakness is disposed in the pressure chamber, and a second position, wherein the area of weakness is disposed at the gap.

7. The window cutting system according to claim 1, further comprising: a mechanical fastener extending into the pin in the recess.

8. The window cutting system according to claim 7, wherein the mechanical fastener includes a tapered surface that selectively engages with a tapered surface section of the passage.

9. A resource exploration and recovery system comprising:

a surface system;

a subsurface system including a tubular string extending from the surface system into an earth formation, the tubular string including window cutting system comprising:

a whipstock including an outer surface, an inner surface having a recess, and a passage extending through the outer surface and the inner surface in the recess;

a window mill connected to the whipstock, the window mill including a body having a first end connected to the tubular string and a second end that is opposite the first end, the second end defining a tip portion, the body having a longitudinal axis that extends through the first end and the tip portion, a pressure compartment formed in the tip portion, and an axial passage extending along the longitudinal axis though the tip portion from the pressure compartment; and a pin connecting the window mill and the whipstock, the pin being arranged in the pressure compartment and extending along the longitudinal axis through the axial passage and the passage into the recess, the pin being axially shiftable along the longitudinal axis relative to the window mill and the whipstock when exposed to pressure in the pressure compartment.

10. The resource exploration and recovery system according to claim 9, further comprising: a fluid port extending through the window mill into the pressure compartment.

11. The resource exploration and recovery system according to claim 10, further comprising: a hydraulic line connected to the fluid port.

12. The resource exploration and recovery system according to claim 9, further comprising: a gap extending between the whipstock and the window mill.

13. The resource exploration and recovery system according to claim 12, wherein the pin includes an area of weakness, the pin being selectively separable at the area of weakness to disengage the window mill from the whipstock.

14. The resource exploration and recovery system according to claim 13, wherein the pin is selectively shiftable between a first position, wherein the area of weakness is disposed in the pressure chamber, and a second position, wherein the area of weakness is disposed at the gap.

15. The resource exploration and recovery system according to claim 9, further comprising: a mechanical fastener extending into the pin in the recess.

16. The resource exploration and recovery system according to claim 15, wherein the mechanical fastener includes a tapered surface that selectively engages with a tapered surface section of the passage.

17. A method of disconnecting a window mill from a whipstock comprising:

running a tubular string including a window cutting system into a wellbore;

introducing fluid into a pressure chamber in the window mill;

shifting a pin in the window mill along a longitudinal axis defined between the window mill and the whipstock toward the whipstock;

applying a torsional force to the window mill to break the pin; and shifting the window mill relative to the whipstock.

18. The method according to claim 17, wherein shifting the pin includes positioning an area of weakness in the pin between the window mill and the whipstock.

19. The method according to claim 18, wherein applying the torsional force includes shearing the area of weakness.

20. The method of claim 17, wherein introducing the fluid includes passing fluid from a surface system to a packer supported on the tubular string and into the pressure chamber.

* * * * *